United States Patent [19]

Powers

[11] 4,177,536

[45] Dec. 11, 1979

[54] KINETIC BRUSH AGITATOR WITH BACK UP BEATER BAR

[75] Inventor: Joseph A. Powers, Canton, Ohio

[73] Assignee: The Hoover Company, North Canton, Ohio

[21] Appl. No.: 966,804

[22] Filed: Dec. 6, 1978

[30] Foreign Application Priority Data

May 12, 1978 [GB] United Kingdom ..... 19275/78

[51] Int. Cl.[2] ..... A46B 7/10; A47L 5/00

[52] U.S. Cl. ..... 15/182; 15/366

[58] Field of Search ..... 15/179–183, 15/366, 383, 386

[56] References Cited

U.S. PATENT DOCUMENTS

| | | | |
|---|---|---|---|
| 1,886,129 | 11/1932 | Smellie | 15/182 |
| 2,045,270 | 6/1936 | Hoover | 15/183 |
| 2,734,212 | 2/1956 | Koch | 15/183 |

FOREIGN PATENT DOCUMENTS

| | | | |
|---|---|---|---|
| 535258 | 4/1941 | United Kingdom | 15/366 |

*Primary Examiner*—Peter Feldman

[57] ABSTRACT

The invention provides an agitator having a beater bar and brush configuration in which the brush is closely mounted relative to the beater bar so as to receive reinforcement from it during the cleaning operation so as to have a kinetic action.

2 Claims, 4 Drawing Figures

KINETIC BRUSH AGITATOR WITH BACK UP BEATER BAR

BACKGROUND OF THE INVENTION

1. Field of the Invention

The invention relates to floor care appliances and, more particularly, relates to an agitator arrangement having a kinetic action.

2. Description of the Prior Art

In suction cleaners having a driven agitator which agitates the rug while cleaner operation is ongoing, the problem experienced is the amount of actual agitation at or below the rug surface so that the pickup of the cleaner is enhanced because of the amount of dirt dislodged from the rug.

Agitators are known having a separate brush and beater bar structure where the two combine for individual agitation to aid in the pickup of dirt from the rug. Agitator structures are even known where the brush strip has a backup configuration that, although designed primarily for mounting the agitator, per se, would function as a beater bar and since it is arranged closely to its brush strip would reinforce it during its cleaning operation.

However, no one heretofore that is known to Applicant has taken advantage of the use of a beater bar as a backup reinforcement for the brush strip in such manner as to impart to the brush and beater bar assemblage a kinetic action tending to aid and increase its effectiveness as a cleaning aid for the vacuum cleaner with which the brush and beater bar agitator is mounted.

Accordingly it would be advantageous to provide a brush and beater bar arrangement having enhanced cleaning effectiveness.

It would be an additional advantage of the invention to provide a beater bar brush strip configuration where the brush strip is bent backwardly over the beater bar to impart a flicking action to the rug on which it is being utilized.

It is a still further object of the invention to provide a brush strip and beater bar arrangement where the same are structured in a manner to enhance the cleaning effectiveness of both of them.

BRIEF SUMMARY OF THE INVENTION

According to the present invention, a suction cleaner is provided having an agitator arrangement in which the brush of the agitator is placed very closely adjacent to what could be considered the beater bar. This brush extends outwardly beyond the beater bar so that during carpet agitation the same is bent backward over the beater bar as the agitator rotates. By this arrangement the beater bar is softened in its use so that the same agitator can be utilized on hard floors as well as rugs. At the same time, the extension of the brush beyond the beater bar and its bending thereover causes a flexure of the brush material as it rotates into the rug that provides a release of energy to the rug itself thereby dislodging a greater amount of dirt and dirt particles from it as the agitator, proper, rotates. In order to insure this proper flexure of the brush, it has been found that the bending shoulder on the agitator beater bar on which the brush is bent should be between one quarter and three quarters of the bristle extension beyond its anchorage and the radius of the shoulder should be less than about one quarter of the bristle free length from its anchorage.

This dimensioning is found to be most advantageous in actual use.

The agitator itself is otherwise conventional and includes capped bearing means for rotationally bearing it in the cleaner proper.

BRIEF DESCRIPTION OF THE DRAWINGS

Reference may now be had to the accompanying drawings for a better understanding of the invention, both as to its organization and function, with the illustration being of a preferred embodiment, but being only exemplary, and in which.

DETAILED DESCRIPTION OF THE INVENTION

Figure 2:
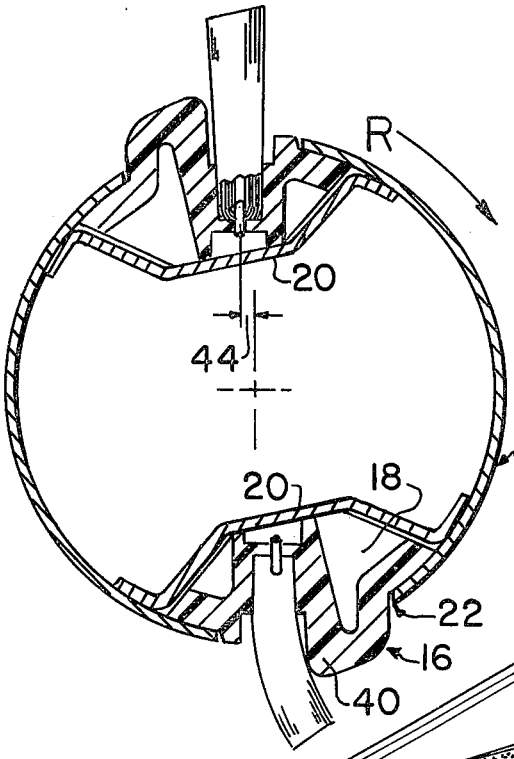
FIG. 2 is an enlarged cross-sectional view taken along line 2—2 of FIG. 1.

The agitator 10 is shown which includes a pair of end caps 12 and 14. These end caps act as bearings for the reception of the remainder of the agitator 10 for rotation as is conventional in the art. A series of brush strips 16, 16, 16 and 16 are mounted with agitator 10 through each being slidably mounted in a spiralling slot 18 so as to be disposed longitudinally in a spiral configuration along the agitator 10. The bottom of the slot 18 is formed by means of an angled sheet piece 20 welded to the internal periphery of the agitator 10. An opening 22 of slot 18 permits extension of the brush strip 16 beyond the external periphery of the agitator 10. Thus, the brush strip 16 is easily pushed into the end of the agitator 10 and limited in its radially inward movement by the angled sheet piece 20 while a hole 22 of slot 18 permits extension radially outwardly so that the same is captured in the agitator 10. Placing of the end caps 12 and 14 thereon, prevents axial movement of the brush strips 16. This is conventional in the art.

Figure 3:
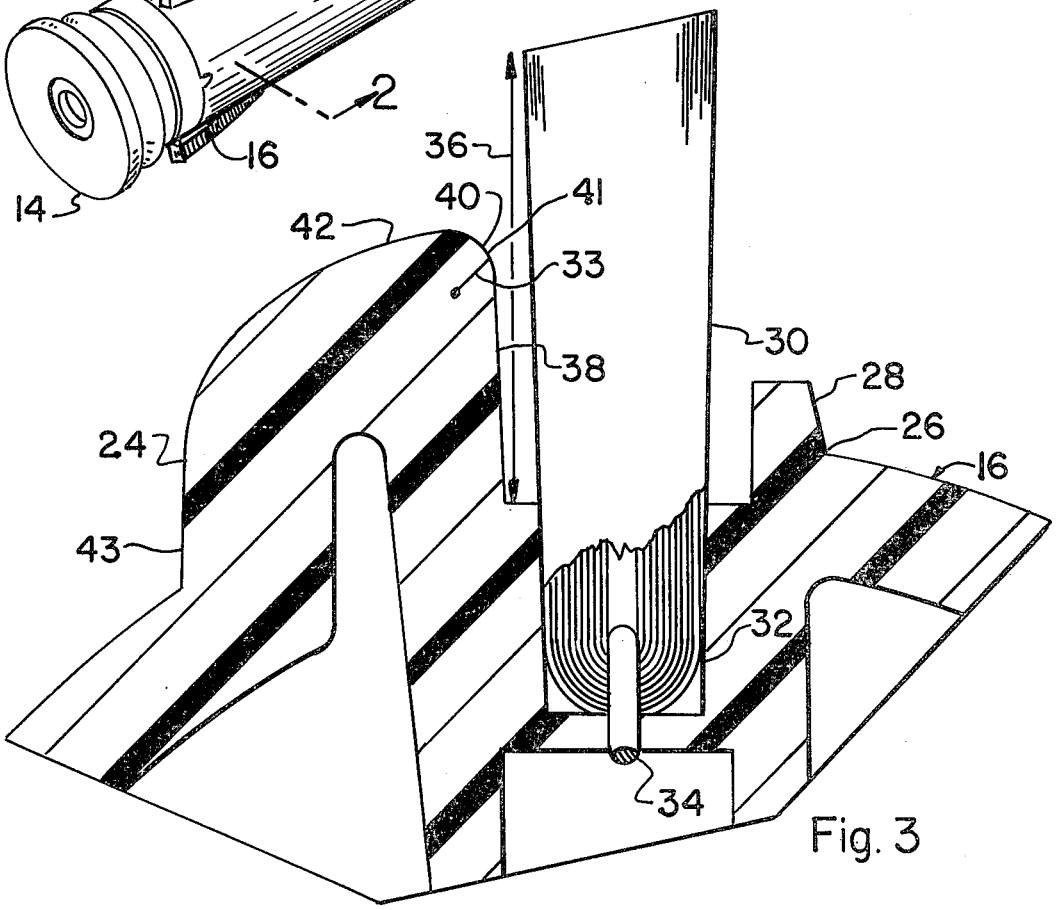
FIG. 3 is an enlarged cross-sectional view of the beater bar brush assembly.

The brush holding strip 16 (FIG. 3) is comprised of a beater bar portion 24 and a brush holding section 26. Brush holding section 26 includes a ridge 28 which extends the length of the brush strip and engages against the side of the agitator 10 and helps maintain the brush strip 16 in place within the agitator 10. Disposed inwardly of the ridge 28 and towards the beater bar 24 is a brush structure 30 that is disposed in a well 32 by means of staples 34 (only one shown) conventional also in the art. The well 32 as well as the staple 34 tightly hold the brush in its lower end so that a free length 36 of the brush structure 30 extends from the upper termination of the well 32 to the outward working tip of the brush structure 30.

The ridge 28 of brush strip 16 is spaced from the brush structure 30 to provide free play of the brush structure as the same is bent during the cleaning operation. The radially extending flat wall or side 38 of beater bar 24 extends upwardly from the free point where the brush structure 30 is anchored and includes in its upper edge a radiused shoulder 40 to permit flexure of the brush thereover. It has been suggested that the best location of this shoulder and the flexure point furnished is between a quarter and three quarters of the bristle free length of extension 36 beyond its anchorage in the well 32 to provide a rigidifying effect to the bent bristle. It has also been suggested that the shoulder should have a radius 33 of less than a quarter of the bristle free length above its well 32 to provide sufficient arcuity to the bent bristles. These dimensions then provide a flicking reaction of the brush as it rotates with the agitator 10 tending to impart a certain amount of additional energy to the carpet during the sweeping motion of the brush thus aiding in the cleaning action of a rug undergoing cleaning.

Outwardly of a surface 41 formed by the shoulder 40 is a smooth curvilinear section 42 that merges back into agitator 10 by merging with a radially extending flat face 43 of beater bar portion 24, the said face 43 extending substantially parallel to side 38. Because of its aerodynamic shape, suction tends to build up a vacuum behind the beater bar 24.

The bending of the brush structure 30 is illustrated in FIG. 2, and, as shown, bends backwardly until it reaches the radius shoulder 40. Upon reaching the radius shoulder it bends over the shoulder so that some of the energy of the beater bar 24 is imparted to the brush structure 30. Then as the tip of the brush structure 30 clears the carpet a flicking action occurs which is extremely advantageous to dirt pick up, the pent up energy of the brush structure providing this improved cleaning.

Figure 4:
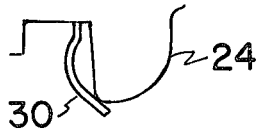
FIG. 4 is a schematic view of a bent brush tuft.
Figure 1:
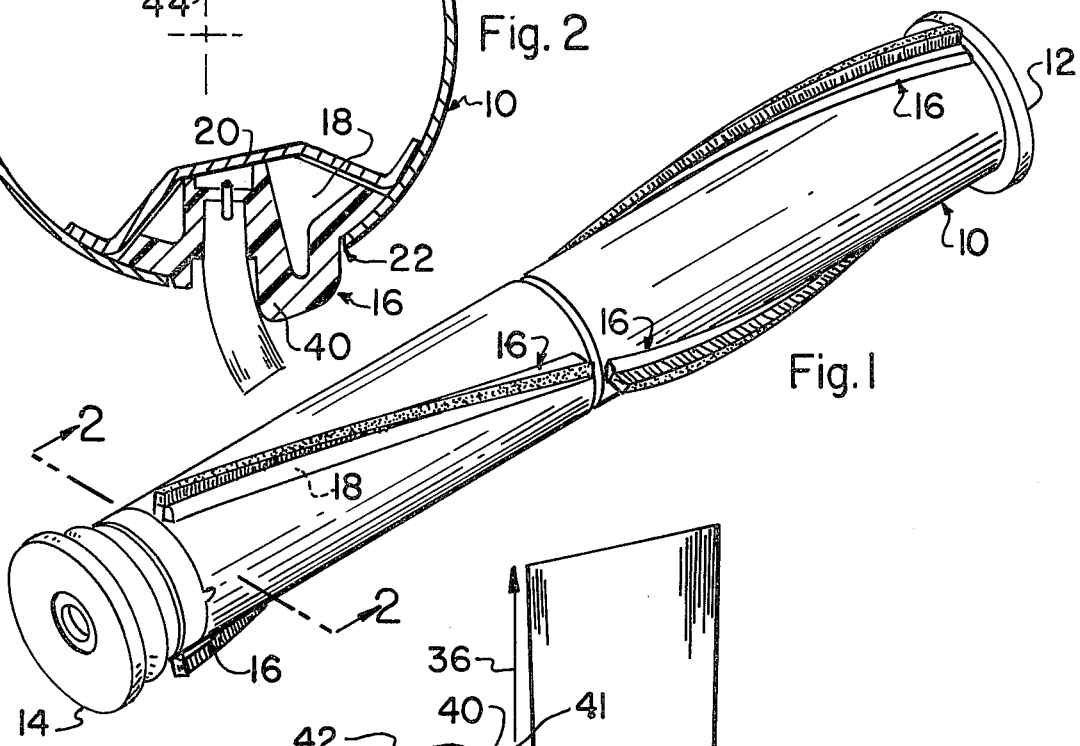
FIG. 1 is a perspective view of an agitator roll which embodies my invention.

FIG. 4 shows schematically one shape that the brush tufts may reach during the cleaning operation. This shape is of a lazy "S" and thereby great potential energy is possessed by the tufts before the flicking action. This shape would, of course, result in higher dirt pick up. A trailing on lagging offset 44 (the centerline of the brush set back from the center of rotation of the agitator) has been determined to be best for the brush structure 30, this limits carpet wear somewhat, this offset being set at 0.050" with an agitator body having an outer diameter of 1.56" and a beater bar outer diameter of 1.95". The outer edge of the anchoring point (well 32) is at a radius of 0.729" on the line from which the 0.050" offset is measured and the length of bristle of brush structure 30 radially outwardly of the end of beater bar 24 is nominally 0.250". This aids in dirt pick up as the agitator 10 rotates.

From the foregoing description it should appear clear that an agitator having a kinetic action has been provided that aids in getting a flicking sweeping action of the brush while engaged with the carpet.

What is claimed is:

1. A suction cleaner agitator having a generally cylindrical body and a beater bar, disposed closely adjacent to a brush having a free length; said beater bar being disposed so as to provide backup for said brush during cleaning rotation and being shorter than said brush; said beater bar having a curved shoulder facing said brush and adjacent the periphery of said beater bar; said shoulder being located at between one quarter and three quarters of the free length of said brush; said brush bending over said shoulder during agitation; said shoulder having a radius of less than one quarter of the free length of said brush; said brush extending from said agitator body in a trailing relationship, with the centerline of the brush offset from the center of the agitator body in the direction of the beater bar, rearwardly relative to the direction of rotation of the agitator body.

2. A suction cleaner agitator having a beater bar, disposed closely adjacent to a brush having a free length; said beater bar being disposed so as to provide backup for said brush during cleaning rotation and being shorter than said brush; said beater bar having a curved shoulder facing said brush and adjacent the periphery of said beater bar; said shoulder being located at between one quarter and three quarters of the free length of said brush; said shoulder having a radius of less than one quarter of the free length of the brush; said beater bar having a radially extending flat side facing said brush and merging at its outer end into said shoulder; and said beater bar having a radially extending flat face, remote from and extending substantially parallel to said flat side, said beater bar having a curved external face between said shoulder and said radially extending flat face to form an areodynamic shape which, do to suction produced thereby, tends to build up a vacuum behind said beater bar.

* * * * *